US012781525B2

(12) United States Patent
Alves

(10) Patent No.: US 12,781,525 B2
(45) Date of Patent: Nov. 3, 2026

(54) GRIDS AND POSTS WITH ADJUSTABLE CLAWS FOR THE ASSEMBLY OF GUARDRAILS IN CONSTRUCTION WORK

(71) Applicant: MPM Locações Importação E Exportação Ltda., Fortaleza (BR)

(72) Inventor: Geraldo Magela Alves, Fortaleza (BR)

(73) Assignee: MPM LOCAÇÕES IMPORTAÇÃO E EXPORTAÇÃO LTDA, Fortaleza (BR)

( * ) Notice: Subject to any disclaimer, the term of this patent is extended or adjusted under 35 U.S.C. 154(b) by 133 days.

(21) Appl. No.: 18/954,743

(22) Filed: Nov. 21, 2024

(65) Prior Publication Data

US 2025/0172006 A1 May 29, 2025

(30) Foreign Application Priority Data

Nov. 28, 2023 (BR) ..... 1020230249620

(51) Int. Cl.
*E04G 21/32* (2006.01)
*E04G 11/48* (2006.01)

(52) U.S. Cl.
CPC ..... *E04G 21/32* (2013.01); *E04G 11/48* (2013.01)

(58) Field of Classification Search
CPC ..... E04G 21/3233; E04G 21/3242; E04G 2005/148; E04G 21/3266
See application file for complete search history.

(56) References Cited

U.S. PATENT DOCUMENTS 2,709,073 A * 5/1955 Dougherty ..... E04H 17/163 256/24
6,585,080 B2 * 7/2003 Murray ..... E04G 21/3242 248/231.71
6,857,504 B1 * 2/2005 Branter ..... E04G 21/3214 248/237
10,240,357 B2 * 3/2019 Cockerell ..... E04G 21/3266
11,719,009 B2 * 8/2023 MacKarvich ..... E04G 21/3242 256/68
2003/0132427 A1 * 7/2003 Allenbaugh ..... E04G 21/3233 256/65.14
2022/0056715 A1 * 2/2022 O'Mara ..... E04G 21/3242
2023/0092797 A1 * 3/2023 Kearns ..... E04G 21/3223 256/21

FOREIGN PATENT DOCUMENTS

FR 2953542 A1 * 6/2011 ..... E04G 21/3266

* cited by examiner

*Primary Examiner* — Sarah B McPartlin
(74) *Attorney, Agent, or Firm* — Kaustubh Nadkarni; Nadkarni Law PLLC

(57) ABSTRACT

Grids and posts with adjustable claws for use in the assembly of guardrails in construction work, serving as temporary peripheral protection railings on slab floors. This system avoids the time and high labor costs of drilling holes in concrete to fix support structures for various grid models. The post attachment system ensures safe assembly and disassembly, with a fast and reliable mechanism for opening and closing the claws. The invention includes grids with quick-fit rings and posts with adjustable claws, which operate through a spindle with a crank. The claws have a large spacing capacity between their lower and upper parts, and the posts are fixed to slabs or edge beams by the pressure applied when closing the claws. The grid support design allows for easy, secure placement and removal of grids, significantly increasing productivity.

4 Claims, 4 Drawing Sheets

GRIDS AND POSTS WITH ADJUSTABLE CLAWS FOR THE ASSEMBLY OF GUARDRAILS IN CONSTRUCTION WORK

CROSS-REFERENCE TO RELATED APPLICATIONS

This application claims priority from a foreign utility patent application with the foreign patent application number BR1020230249620 filed on Nov. 28, 2023. The entire collective teachings thereof being herein incorporated by reference.

STATEMENT REGARDING FEDERALLY SPONSORED RESEARCH OR DEVELOPMENT

Not Applicable.

FIRST NAMED INVENTOR

Geraldo Magela Alves.

FIELD OF THE INVENTION

This invention privilege descriptive report refers to the grids and posts with adjustable claws for the assembly of guardrails in construction work, comprising posts with adjustable claws and quick-fit grids for the assembly of railings on the periphery of the slab floor, constituting a necessary safety structure for workers in various construction sites.

The application field of this invention is the protection and safety structures applied to construction work, more specifically, the field of temporary peripheral protection railings or guardrails on slab floors during construction.

BACKGROUND OF THE INVENTION

As those qualified in this field know, there are several techniques for assembling temporary protective grids on the periphery of slab floors, as well as equipment for this purpose, however, none of them has the innovative characteristics claimed in this patent application.

It is known that safety in the execution of civil construction works must comply with several technical standards, whether for the safety of structures, workers and other people, and even the surroundings of the construction site, everything must comply with safety standards with, at least, the following characteristics:

The protection, consisting of rigid bulkheads with total gap closure, must have a minimum height of 1.2 m (one meter and twenty centimeters).

The protection, when consisting of rigid bulkheads in a guardrail and skirting system, must meet the following requirements:

a) an upper beam at a height of 1.2 m (one meter and twenty centimeters), with a resistance to a horizontal load of 90 kgf/m (ninety kilograms-force per meter) and a maximum deflection that must not exceed 0.076 m (seventy-six millimeters);

b) an intermediate beam at a height of 0.7 m (seventy centimeters) and a resistance to horizontal load of 66 kgf/m (sixty-six kilograms-force per meter);

c) a skirting board with a minimum height of 0.15 m (fifteen centimeters) close to the surface and a horizontal load resistance of 22 kgf/m (twenty-two kilograms-force per meter);

d) Gaps between the sleepers must be covered by a screen or another device that ensures the safe closing of the gaps.

The existing systems for mounting guardrails on the periphery of slabs use posts, bolted directly to the slab or edge beam, such as the systems found during research of patent databases.

The following guardrail systems, which meet safety standards, were identified on the INPI database, with the respective characteristics:

a) Patent application No. BR 102013026300-1, named "TEMPORARY COLLECTIVE PROTECTION SYSTEM FIXATION DEVICE AND TEMPORARY COLLECTIVE PROTECTION SYSTEM", characterized by the fact that it is a fixation base with a tubular support element for the placement of stretching poles for the assembly of the railings, the fixation of these bases is carried out directly on the slab or edge beam, through anchors or screws.

b) Patent application No. BR 202015018384-0, named "CONSTRUCTIVE PROVISION APPLIED TO PERIPHERAL PROTECTION FOR CONSTRUCTION", consists of vertical poles with coupling eyes, where "L" support supports (support brackets) are inserted and arranged in a protection grid, these vertical poles have perpendicular front bars, which are fixed through screws and plugs in the main body of buildings.

c) Patent application No. BR 102016013796-9, named "VERTICAL SUPPORT FOR CONSTRUCTION WORKS", comprises a configurative variation of a metal base that is fixed directly to the slab or edge beam. Each base model has a horizontal rail where the upper part of the vertical support slides, to which the protective railings are attached. Its main characteristic is the fact that the configuration of the base models allows the distancing or approximation to the structure of the building to which the base is fixed, however, it is necessary to close the gap that is formed by moving the vertical supports apart through the horizontal rails.

d) Patent application No. BR 102019004195-1, named "VERTICAL PROTECTION SUPPORT FOR CIVIL CONSTRUCTION WORKS", also composed of two models of bases, one in the shape of an "F" and the other in the shape of a "T", one for fixing to an edge beam and the other for direct fixing to the slab, respectively, both through screws. They serve as a base for coupling vertical poles to which the protection grids are attached, and it may be necessary to use diagonal steel cables to give greater firmness to the structure, further increasing the work in the assembly of this protection system.

Other models of railings and fastening systems were also identified in the INPI database, however, they do not have the same objectives as those pointed out in the previous paragraphs. It is worth mentioning that searches were carried out in other patent databases, such as Espacenet, USPTO, and Google, and no similar product to the one claimed now was found, except for Google, which points to the products already described in the previous paragraph.

It turns out that all the available products for this purpose, that is, the assembly of guardrails on railing floor slabs, without exception, are fixed through bolts, dowels, or "parabolts". The assembly operation of such systems takes a long time and requires a lot of effort, and a lot of time is lost in the drilling of the holes to attach the grid support devices to the concrete slabs or edge beams. It is well known that human labor and time represent very high costs in construction work.

BRIEF SUMMARY OF THE INVENTION

Therefore, searching for more practical and efficient solutions to reduce costs and time spent on the assembly of protective railings for construction works, the inventor developed the grids and posts with adjustable claws for the assembly of guardrails in construction work, composed of grids of quick fitting and posts with adjustable claws that open and close through a spindle with a crank, with a high distancing capacity between the lower and upper parts of the claw, so that they can grip thinner or thicker slabs, as well as edge beams. The greatest advantage of the system of fixation of posts is the agility of its assembly and disassembly on the slabs, the extreme quickness and safety of the opening and closing of the claws, without the need to drill holes in concrete to fix bases or grid posts, providing a significant increase in productivity in the assembly of guardrails on the periphery of slab floors. Additionally, the design of the supports of the grids allows quick and safe placement of the grids, as well as facilitates their removal, which occurs in a simple and fast way. The grids have quick-fit rings with a specific diameter for the perfect fit in the "L"-shaped supports, resulting in firm and secure guardrail structures.

BRIEF DESCRIPTION OF THE DRAWINGS

For a better understanding of the present invention, named "GRIDS AND POSTS WITH ADJUSTABLE CLAWS FOR ASSEMBLY OF GUARDRAILS IN CONSTRUCTION WORK", a detailed description, referring to the attached drawings, is provided below.

DETAILED DESCRIPTION OF THE INVENTION

Figure 1:
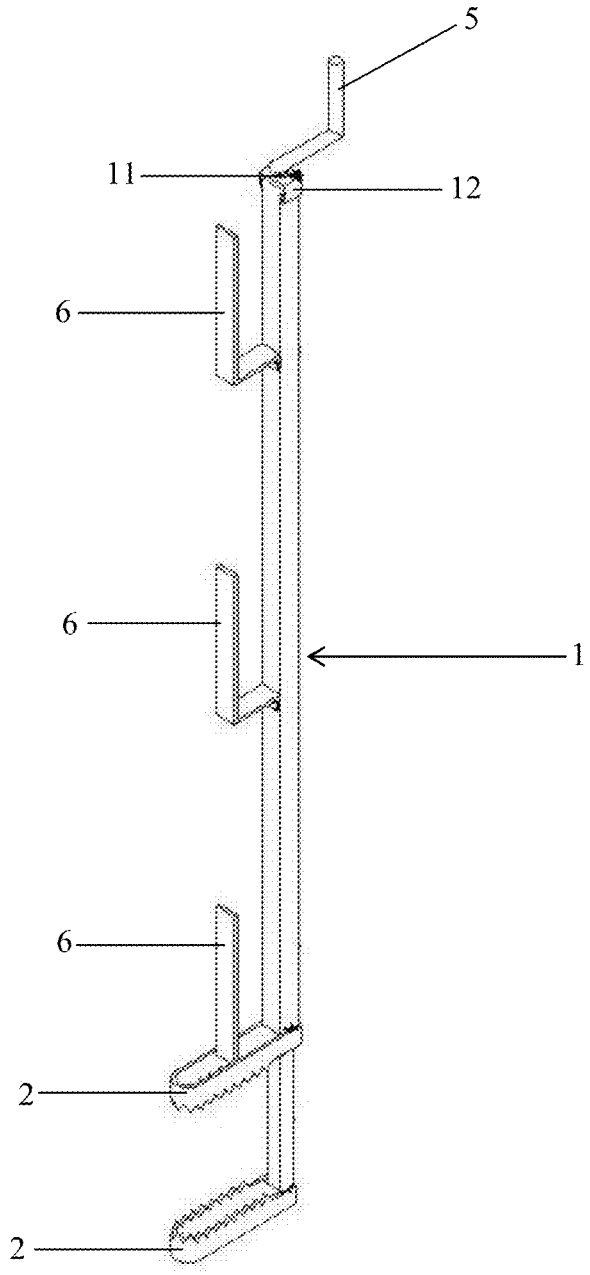
FIG. 1 is an isometric view of a post (1)
Figure 2:
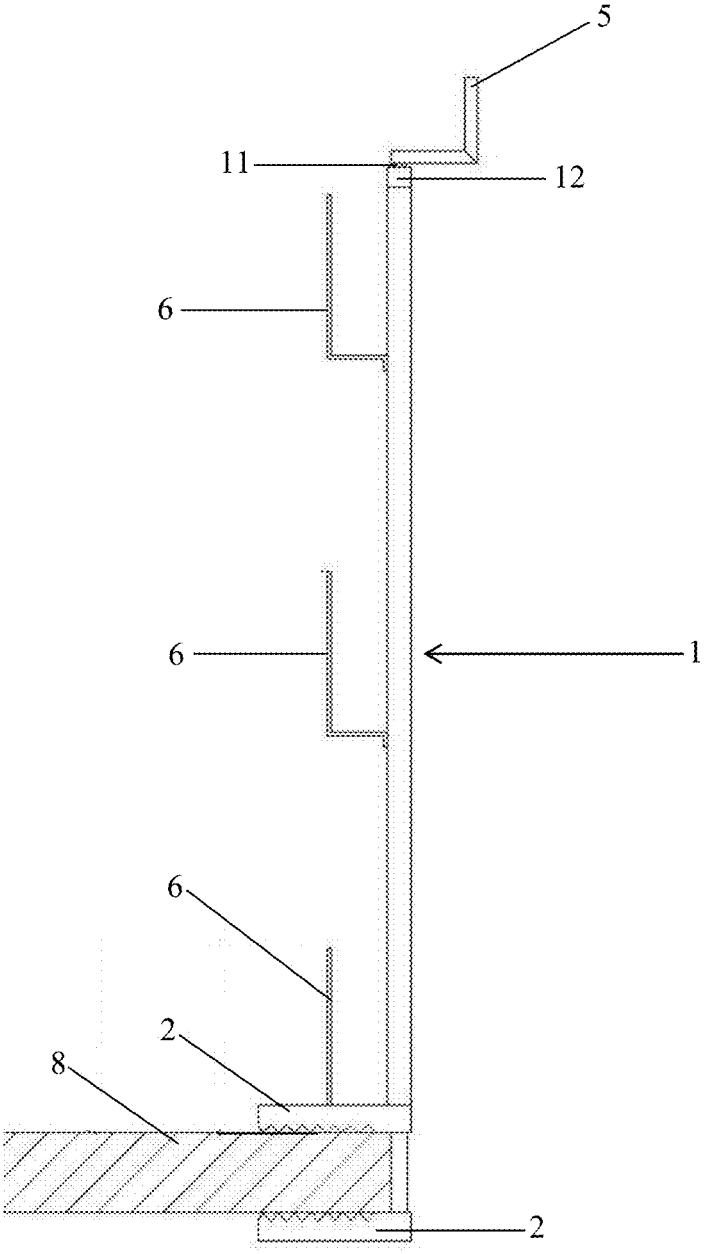
FIG. 2 is a side view of a post (1) fixed to a slab edge (8)
Figure 3:
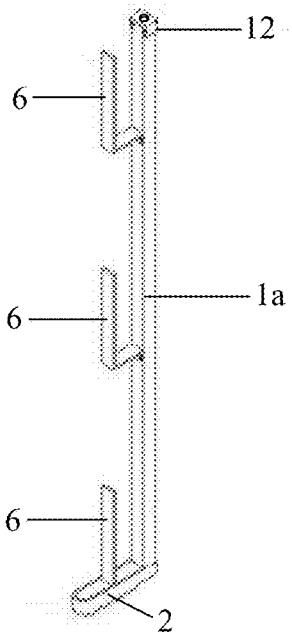
FIG. 3 is an isometric view of the external upper part pole (1*a*) of a post (1)
Figure 4:
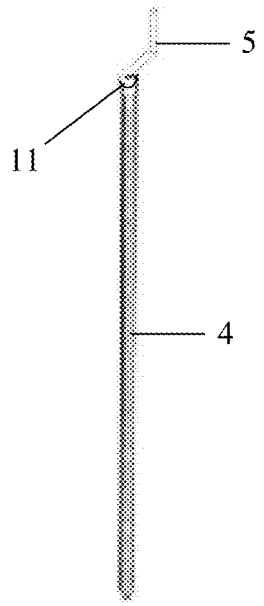
FIG. 4 is an isometric view of a spindle (4) of a post (1)
Figure 5:
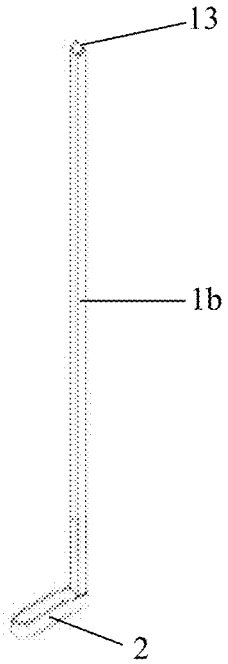
FIG. 5 is an isometric view of the internal lower part pole (1*b*) of a post (1)
Figure 6:
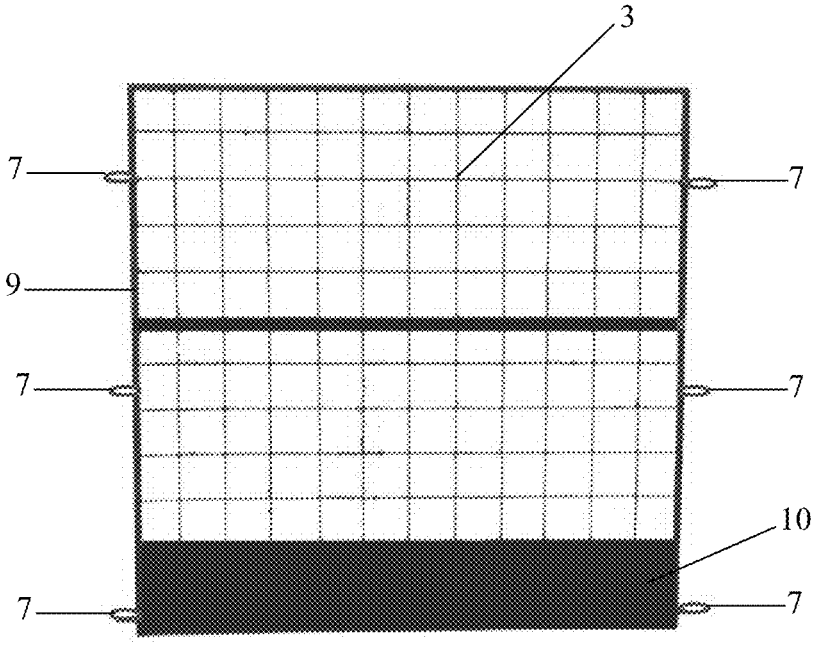
FIG. 6 is a front view of the grid (3)
Figure 7:
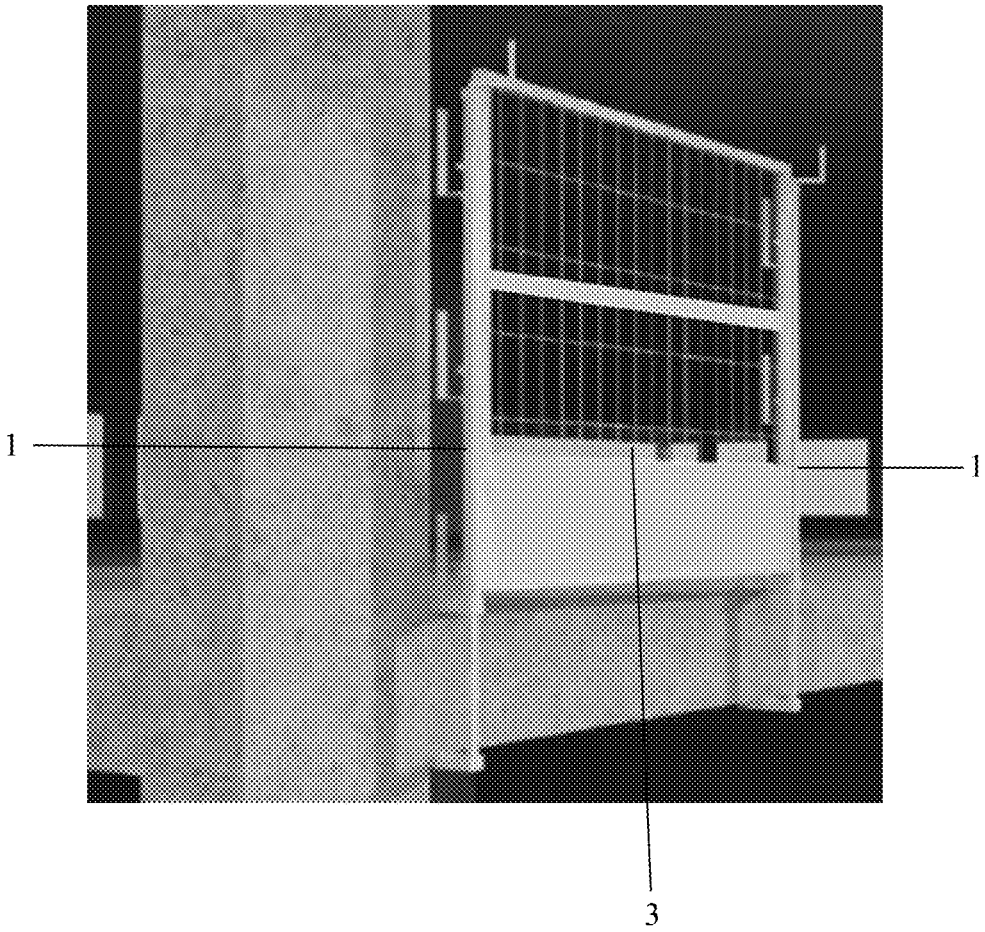
FIG. 7 represents an assembled grid (3), with the posts (1) fixed to the slab edge (8) of a building under construction.

In the preferred embodiment, as illustrated in FIGS. 1 to 7, the present invention is designed to speed up the process of assembling and disassembling guardrails on the periphery of slab floors of buildings under construction in a simple and fast way, and the present invention comprises posts (1) with adjustable claws (2) and quick-fitting grids (3).

The posts (1) are made up of three parts, i.e., an external upper part pole (1*a*), formed by a square tubular pole; a spindle (4) with a crank (5) and an internal lower part pole (1*b*), also formed by a tubular pole, with the external upper part pole (1*a*) being larger in width than the lower part pole (1*b*). The internal lower part pole (1*b*) fits into the external upper part pole (1*a*) and the internal lower part pole (1*b*) slides inside the external upper part pole (1*a*). Each post (1) also has three "L"-shaped supports (6) for fitting the grids (3), welded to the front portion of the external upper part pole (1*a*).

The claws (2) of the posts (1) consist of two parts, an upper part fixed perpendicularly to the base of the external upper part pole (1*a*) and a lower part fixed perpendicularly to the base of the internal lower part pole (1*b*). The claws (2) have pointed teeth facing inwards, which provide firmness in fixing the posts (1) to the concrete structures.

The grids (3) consist of steel mesh panels with four peripheral bars (9) welded together, forming a rectangle, with a horizontal reinforcement bar in the central portion, as well as a steel plate (10) in the lower portion and quick-fit rings (7) on the sides for the perfect fitting of the "L"-shaped supports (6) to the posts (1). Such grids (3) may have varying widths to allow the closure of the entire periphery of the slabs, which may have different lengths.

The spindle (4) of the post (1) consists of a threaded shaft with a nut (11) at the top and a crank (5) fixed just above the shaft nut (11). In the external upper part pole (1*a*) of the post (1), there is a "U"-shaped plate (12) with a central hole, through which the spindle (4) passes, which threads into a square nut (13) fixed to the internal lower part pole (1*b*) of the post (1).

The operation of the posts (1) is very simple: turn the spindle (4) through the crank (5) to the right side and the claws (2) open, and turn the spindle (4) to the opposite side to close the claws (2). When you have enough opening of the claws (2) to hold the slab or edge beam, press the spindle (4) down with enough force to secure the post (1) to the structure. Several posts (1) are fixed to the periphery of the slab floor at a distance suitable for the size of the grids (3), which are fitted to the posts (1), where there is a pair of posts (1) attached to the slab.

The present invention provides an efficient system for assembling guardrails in construction work, featuring grids and posts with adjustable claws that serve as temporary peripheral protection railings on slab floors. By eliminating the need for drilling holes in concrete, the system reduces both installation time and labor costs. The design facilitates quick, secure placement and removal of the grids, significantly enhancing productivity and operational efficiency in construction environments.

What is claimed is:

1. A guardrail assembly for providing temporary protection on slab floors during construction work, comprising:

a plurality of grids (3) each with a plurality of quick-fit rings (7); and a plurality of posts (1), wherein each post (1) comprises, an external upper part pole (1*a*) and an internal lower part pole (1*b*), wherein the external upper part pole (1*a*) is formed by a square tubular pole provided with a "U"-shaped plate (12) having a central hole in an upper portion of the external upper part pole (1*a*), which threads into a square nut (13) fixed to the internal lower part pole (1*b*) so that the internal lower part pole (1*b*) slides telescopically inside the external upper part pole (1*a*);

an adjustable opening claw (2) comprising an upper part and a lower part providing a large distance capacity between the lower part and the upper part of the claw (2), wherein the upper part of the claw (2) is welded to a front part of the external upper part pole (1*a*), and the claw (2) opens and closes through a spindle (4) driven by a crank (5), wherein the spindle (4) is provided with a thread and a nut (11) at a top thereof, with the crank (5) fixed just above the nut (11), wherein the posts (1) are fixed to a slab or a slab edge beam by pressure when the spindle (4) drives the internal lower part pole (1*b*) to close the corresponding claw (2).

2. The guardrail assembly according to claim 1, wherein each grid (3) comprises three quick-fit rings (7) on each side fixed equidistantly and proportionally to dimensions of three "L"-shaped supports (6) fixed to the post (1), a width of bars forming the "L"-shaped supports (6) and a spacing between the "L"-shaped supports (6), and wherein each grid (3) is formed by four bars (9) welded together in a rectangle with a horizontal reinforcing bar in a center thereof and a steel plate (10) at a bottom thereof.

3. The guardrail assembly according to claim 1, wherein the internal lower part (1*b*) is formed by a tubular pole with the lower part of the claw (2) welded perpendicularly to a base of the internal lower part pole (1*b*), and wherein the external upper part pole (1*a*) is formed by the square tubular pole with the upper part of the claw (2) welded perpendicularly to a base of the external upper part pole (1*a*).

4. The guardrail assembly according to claim 1, wherein the upper part and the lower part of the claw (2) comprise pointed teeth facing inwards.

* * * * *